US007141281B2

(12) United States Patent
Hirota et al.

(10) Patent No.: US 7,141,281 B2
(45) Date of Patent: Nov. 28, 2006

(54) PROTECTIVE LAYER TRANSFER SHEET AND THERMALLY TRANSFERRED IMAGE RECORDED OBJECT

(75) Inventors: Kenichi Hirota, Tokyo-To (JP); Mitsuru Maeda, Tokyo-To (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 10/947,668

(22) Filed: Sep. 23, 2004

(65) Prior Publication Data

US 2005/0208297 A1 Sep. 22, 2005

(30) Foreign Application Priority Data

Sep. 24, 2003 (JP) ..... 2003-331846
Sep. 24, 2003 (JP) ..... 2003-332342

(51) Int. Cl.
*B41M 5/40* (2006.01)

(52) U.S. Cl. ..... 428/32.69; 428/32.72; 428/32.79

(58) Field of Classification Search ..... None
See application file for complete search history.

(56) References Cited

U.S. PATENT DOCUMENTS 6,737,152 B1 * 5/2004 Suzuki et al. ..... 428/195.1
6,815,397 B1 * 11/2004 Ishida et al. ..... 503/227
6,819,348 B1 * 11/2004 Tamura et al. ..... 347/217
2002/0197453 A1 12/2002 Usuki et al. ..... 428/195
2003/0077428 A1 4/2003 Ishida et al. ..... 428/195

FOREIGN PATENT DOCUMENTS

| | | |
|---|---|---|
| EP | 0 775 593 A1 | 5/1997 |
| EP | 1 232 874 A1 | 8/2002 |
| JP | 08-324140 | 12/1996 |
| JP | 2002-240404 | 8/2002 |

* cited by examiner

*Primary Examiner*—Jennifer C. McNeil
*Assistant Examiner*—Timothy M. Speer
(74) *Attorney, Agent, or Firm*—Oliff & Berridge, PLC

(57) ABSTRACT

There are provided a protective layer transfer sheet that is excellent in transferability of a thermally transferable protective layer from a substrate sheet and can yield a protective layer having excellent durability such as abrasion resistance and scratch resistance, weathering resistance, chemical resistance, solvent resistance, stampability and writability with an aqueous ink, and a thermally transferred image recorded object using the same. The protective layer transfer sheet comprises: a substrate sheet; and a thermally transferable protective layer provided on at least a part of one side of the substrate sheet, wherein the thermally transferable protective layer forms a protective layer having a water absorptive property upon thermal transfer, the thermally transferable protective layer comprises at least a peel layer, a stampable and writable protective layer formed of a water resistant porous layer and a water absorptive resin, and a heat-sensitive adhesive resin layer provided in that order as viewed from the substrate sheet side, and the peel layer comprises at least a water soluble resin, fine particles, and a curing agent, the water soluble resin having a number average molecular weight in the range of 10000 to 30000.

16 Claims, 2 Drawing Sheets

PROTECTIVE LAYER TRANSFER SHEET AND THERMALLY TRANSFERRED IMAGE RECORDED OBJECT

BACKGROUND OF THE INVENTION

1. Field of the Invention

The present invention relates to a thermal transfer sheet, for a protective layer, with a protective layer separably provided thereon. More particularly, the present invention relates to a protective layer transfer sheet that can yield a protective layer, which can impart stampability and writability with a pen using an aqueous ink, a fountain pen or the like to an image formed by thermal transfer recording and is excellent in layer transferability, abrasion resistance, scratch resistance, weathering resistance, chemical resistance, solvent resistance and the like, and a thermally transferred image recorded object and a print using the same.

2. Background Art

At the present time, thermal transfer recording is widely used as a simple printing method. The thermal transfer recording can simply form various images and thus is utilized in printing wherein the number of prints may be relatively small, for example, in the preparation of ID cards, such as identification cards or photographs for business, or is utilized, for example, in printers of personal computers or video printers.

When a full-color gradational image such as a photograph-like image of a face is desired, the thermal transfer sheet used is such that, for example, colorant layers of yellow, magenta, and cyan and optionally black are provided as ink layers repeatedly in a large number in a face serial manner on a continuous substrate sheet.

Such thermal transfer sheets are classified roughly into thermal transfer sheets of the so-called "heat-fusion" or "thermal ink transfer" type wherein the colorant layer is melted and softened upon heating and as such is transferred onto an object, that is, an image-receiving sheet, and thermal transfer sheets of the so-called "sublimation dye transfer" or "thermal dye transfer" type wherein, upon heating, a dye contained in the colorant layer is sublimated to permit the dye to migrate onto the image-receiving sheet.

When the above thermal transfer sheet is used, for example, for preparing identification cards or documents, a method known for forming a protective layer on an mage with a view to protecting the image is that a protective layer transfer sheet with a thermally transferable resin layer is stacked on an image formed by the thermal transfer of a heat-fusion colorant layer or thermally sublimable dye and the thermally transferable resin layer is transferred by means of a thermal head, a heating roll or the like to form a protective layer on the image.

The provision of the protective layer can improve abrasion resistance, chemical resistance, solvent resistance and the like of images, and, further, the addition of an ultraviolet absorber or the like to the protective layer can improve lightfastness of the images.

For example, Japanese Patent Laid-Open No. 240404/2002 discloses a thermal transfer sheet for a protective layer in which a thermally transferable protective layer is provided on at least a part of one side of a substrate sheet and the protective layer is a laminate having a structure of at least two layers, that is, comprises at least a layer composed mainly of an acrylic resin and a layer composed mainly of a polyester resin provided in that order on the substrate sheet.

The thermal transfer sheet for a protective layer disclosed in Japanese Patent Laid-Open No. 240404/2002, however, is disadvantageous in that when the formation of aqueous ink images, for example, stamps put at the joining of two leaves, or various stamp images, using an aqueous ink on a thermally transferred image, with a protective layer formed using the thermal transfer sheet for a protective layer, on a photographic paper is contemplated for use, e.g., in a photographic image of a face in a passport, the print cannot absorb and fix the aqueous ink.

To overcome the above problem, for example, Japanese Patent Laid-Open No. 324140/1996 discloses a thermal transfer film for a protective layer. Upon transfer, the thermal transfer film for a protective layer forms a protective layer, for example, in which a water absorptive surface layer constituting the uppermost surface after transfer is a layer capable of absorbing and fixing an aqueous ink and the water absorptive surface layer is a substantially transparent porous layer or a partially water absorptive layer comprising at least water absorptive micro-regions and water resistant micro-regions.

In the thermal transfer film for a protective layer disclosed in Japanese Patent Laid-Open No. 324140/1996, however, the following facts should be noted. Specifically, when a water absorptive surface layer is provided in the transferred protective layer for water absorptive property-imparting purposes, as compared with a conventional thermal transfer sheet for a protective layer which does not impart the water absorptive property, at the time of thermal transfer, disadvantageously, the transferability of the protective layer from a substrate film is poor, that is, the protective layer is not faithfully separated.

SUMMARY OF THE INVENTION

Accordingly, an object of the present invention is to provide a protective layer transfer sheet that can yield a protective layer, which can impart stampability and writability with a pen using an aqueous ink, a fountain pen or the like to an image formed by thermal transfer recording and is excellent in layer transferability, durability such as abrasion resistance and scratch resistance, weathering resistance, chemical resistance, solvent resistance and the like, and a thermally transferred image recorded object and a print using the same.

First Aspect

According to the present invention, there is provided a protective layer transfer sheet comprising: a substrate sheet; and a thermally transferable protective layer provided on at least a part of one side of the substrate sheet, characterized in that said thermally transferable protective layer forms a protective layer having a water absorptive property upon thermal transfer, said thermally transferable protective layer comprises at least a peel layer, a stampable and writable protective layer formed of a water resistant porous layer and a water absorptive resin, and a heat-sensitive adhesive resin layer provided in that order as viewed from the substrate sheet side, and said peel layer comprises at least a water soluble resin, fine particles, and a curing agent, said water soluble resin having a number average molecular weight in the range of 10000 to 30000.

Further, according to the present invention, there is provided a protective layer transfer sheet comprising: a substrate sheet; and a thermally transferable protective layer provided on at least a part of one side of the substrate sheet, characterized in that said thermally transferable protective layer forms a protective layer having a water absorptive property upon thermal transfer, said thermally transferable protective layer comprises at least a peel layer, a stampable and writable protective layer formed of a water resistant porous layer and a water absorptive resin, and a heat-sensitive adhesive resin layer provided in that order as viewed from the substrate sheet side, and said peel layer comprises at least a water soluble resin, fine particles, and a curing agent, said water absorptive resin having a weight average molecular weight in the range of 6000 to 15000.

The protective layer transfer sheet according to the present invention is characterized in that said peel layer is in a cured form formed from a water soluble resin having an active functional group and a curing agent reactive with the active functional group, and the ratio on a solid basis between said water soluble resin and the weight of said curing agent added is in the range of 0.05%≦curing agent/water soluble resin≦2%.

Further, the protective layer transfer sheet according to the present invention is characterized in that the thickness of the peel layer constituting the protective layer transfer sheet is in the range of not less than 0.1 μm and not more than 200 μm (on a dry basis).

The protective layer transfer sheet according to the present invention is characterized in that, in any of the above constructions, said thermally transferable protective layer contains an ultraviolet absorbing material.

The protective layer transfer sheet according to the present invention is characterized in that, in any of the above constructions, wherein said thermally transferable protective layer and at least one of a thermally sublimable colorant layer and a heat-fusion colorant layer are provided in a face serial manner on an identical substrate film.

According to the present invention, there is provided a thermally transferred image recorded object characterized by comprising a thermally transferred image covered with a protective layer which has been thermally transferred from any of the protective layer transfer sheets.

The thermally transferred image recorded object according to the present invention is characterized in that a stamp of an aqueous ink has been affixed onto the thermally transferred protective layer in the thermally transferred image recorded object.

The present invention provides a protective layer transfer sheet that, upon transfer onto an image formed by thermal transfer recording, can yield a protective layer, which can impart stampability with an aqueous ink and writability with a pen using an aqueous ink to a thermally transferred image recorded object originally having no aqueous ink fixation, and is excellent in transferability of a thermally transferable protective layer from a substrate sheet and transfer stability, and is further excellent in durability such as abrasion resistance and scratch resistance, weathering resistance, chemical resistance, solvent resistance and the like, and a thermally transferred image recorded object using the same.

Second Aspect

According to the present invention, there is provided another protective layer transfer sheet comprising: a substrate sheet; and a thermally transferable protective layer provided on at least a part of one side of the substrate sheet, characterized in that said thermally transferable protective layer forms a protective layer having a water absorptive property upon thermal transfer, said thermally transferable protective layer comprises at least a peel layer, a stampable and writable protective layer formed of a water resistant porous layer and a water absorptive resin, and a heat-sensitive adhesive resin layer provided in that order as viewed from the substrate sheet side, and said peel layer comprises at least a water soluble resin, fine particles, a curing agent, and a water dispersion-type polymer, the coverage of said peel layer being not less than 0.1 $g/m^2$ and not more than 0.5 $g/m^2$.

The protective layer transfer sheet according to the present invention is characterized in that the content of the water dispersion-type polymer in the peel layer is in the range of 2 to 10% by weight.

The protective layer transfer sheet according to the present invention is characterized in that, in any of the above constructions, said thermally transferable protective layer contains an ultraviolet absorbing material.

The protective layer transfer sheet according to the present invention is characterized in that, in any of the above constructions, said thermally transferable protective layer and at least one of a thermally sublimable colorant layer and a heat-fusion colorant layer are provided in a face serial manner on an identical substrate sheet.

According to the present invention, there is provided a print characterized by comprising a thermally transferred image covered with a protective layer which has been thermally transferred from any of the above protective layer transfer sheets according to the present invention.

The print according to the present invention is characterized in that a stamp can be affixed using an aqueous ink onto the thermally transferred protective layer in the print.

The present invention can provide a protective layer transfer sheet that, by virtue of an improvement in the strength of the peel layer or by virtue of a reduction in the thickness of the peel layer, is excellent in transferability of the thermally transferable protective layer from the substrate sheet and transfer stability and can yield a protective layer which can impart stampability and writability with an aqueous ink to an image, formed by thermal transfer recording, originally having no aqueous ink fixation, and is excellent in durability such as abrasion resistance and scratch resistance, weathering resistance, chemical resistance, solvent resistance and the like, and a print using the same.

DETAILED DESCRIPTION OF THE INVENTION

First Aspect

Embodiments of the first aspect of the present invention will be described in more detail.

Figure 1:
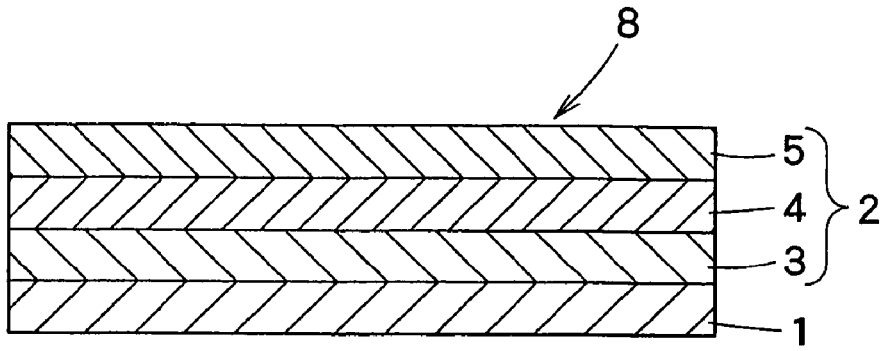
FIG. 1 is a cross-sectional view illustrating one embodiment of the protective layer transfer sheet according to the first aspect of the present invention.

FIG. 1 is a cross-sectional view illustrating one embodiment of a protective layer transfer sheet 8 according to the present invention. The protective layer transfer sheet 8 according to the present invention comprises a substrate sheet 1 and a thermally transferable protective layer 2 provided on one side of the substrate sheet 1. The thermally transferable protective layer 2 comprises a peel layer 3, a stampable and writable protective layer 4 comprising a water resistant porous layer and a water absorptive resin, and a heat-sensitive adhesive resin layer 5 stacked in that order as viewd from the substrate sheet 1 side.

In the above embodiment of the protective layer transfer sheet 8 according to the present invention, the peel layer 3 comprises at least a water soluble resin, fine particles, and a curing agent, and the water soluble resin has a number average molecular weight in the range of 10000 to 30000.

Alternatively, in the above embodiment of the protective layer transfer sheet 8 according to the present invention, the peel layer 3 comprises at least a water soluble resin, fine particles, and a curing agent, and the water absorptive resin constituting the stampable and writable protective layer 4 has a weight average molecular weight in the range of 6000 to 15000.

Alternatively, in the above embodiment of the protective layer transfer sheet 8 according to the present invention, the peel layer 3 is in a cured form formed from a water soluble resin having an active functional group and a curing agent reactive with the active functional group, and the ratio on a solid basis between the water soluble resin, and the weight of the curing agent added is in the range of 0.05%≦curing agent/water soluble resin≦2%, whereby the number average molecular weight is brought to 10000 to 30000.

In the protective layer transfer sheet 8 according to the present invention, upon heating, the thermally transferable protective layer 2 comprising the peel layer 3, the stampable and writable protective layer 4 and the heat-sensitive adhesive resin layer 5 can be separated with good transferability from the substrate sheet 1, and, upon transfer of the thermally transferable protective layer 2, the surface of a thermally transferred image comprising an image of a colorant can be covered with a protective layer to form a thermally transferred image recorded object which is stampable with an aqueous ink and, at the same time, has abrasion resistance, chemical resistance, and solvent resistance.

Figure 2:
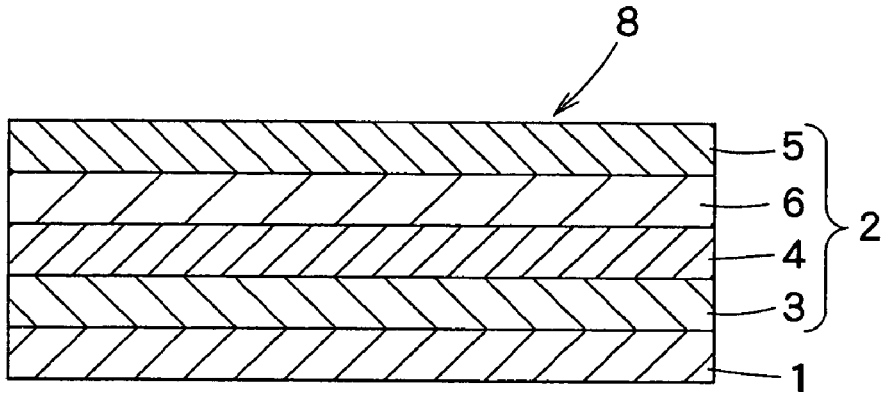
FIG. 2 is a cross-sectional view showing another embodiment of the protective layer transfer sheet according to the first aspect of the present invention.

FIG. 2 is a cross-sectional view illustrating another embodiment of the protective layer transfer sheet 8 according to the present invention. This protective layer transfer sheet 8 comprises a substrate sheet 1 and a thermally transferable protective layer 2 provided on one side of the substrate sheet 1. The thermally transferable protective layer 2 comprises a peel layer 3, a stampable and writable protective layer 4, an ultraviolet light shielding layer 6, and a heat-sensitive adhesive resin layer 5 stacked in that order as viewed from the substrate sheet 1 side.

The protective layer transfer sheet 8 according to the present invention has, in addition to the above function, the function of preventing fading or discoloration attributable to ultraviolet light containing in the sunlight and the like.

Figure 3:
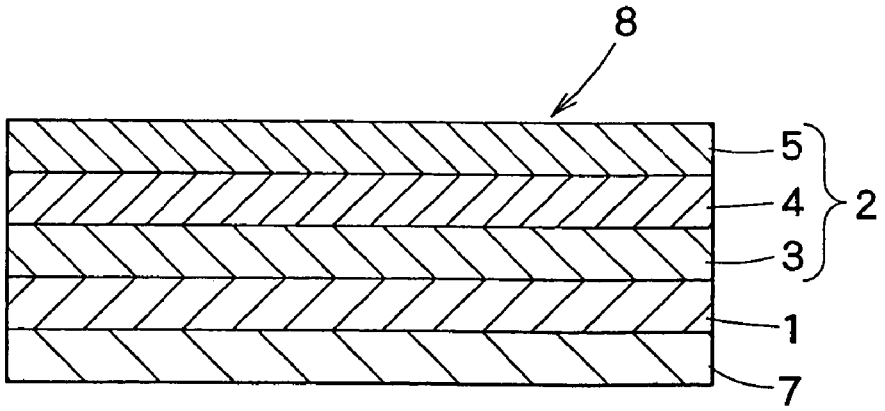
FIG. 3 is a cross-sectional view showing a further embodiment of the protective layer transfer sheet according to the first aspect of the present invention.

FIG. 3 is a cross-sectional view showing still another embodiment of the protective layer transfer sheet 8 according to the present invention. The protective layer transfer sheet 8 shown in FIG. 3 comprises a substrate sheet 1, a heat resistant slip layer 7 provided on one side of the substrate sheet 1, and a thermally transferable protective layer 2 provided on the other side of the substrate sheet 1. The thermally transferable protective layer 2 comprises a peel layer 3, a stampable and writable protective layer 4, and a heat-sensitive adhesive resin layer 5 provided in that order from the substrate sheet 1 side.

The provision of the heat resistant slip layer 7 on the substrate sheet 1 on its side remote from the thermally transferable protective layer 2 can prevent the protective layer transfer sheet from sticking to a thermal head, a hot plate for transfer or the like of a printer and further can improve slipperiness.

Second Aspect

Figure 4:
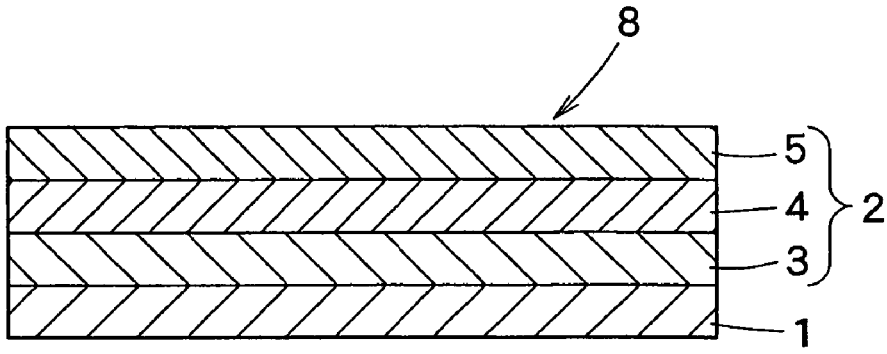
FIG. 4 is a cross-sectional view illustrating one embodiment of the protective layer transfer sheet according to the second aspect of the present invention.

Next, the second aspect of the present invention will be described in more detail with reference to the following embodiments. FIG. 4 is a cross-sectional view illustrating one embodiment of a protective layer transfer sheet 8 according to the present invention. The protective layer transfer sheet 8 according to the present invention comprises a substrate sheet 1 and a thermally transferable protective layer 2 provided on one side of the substrate sheet 1. The thermally transferable protective layer 2 comprises a peel layer 3, a stampable and writable protective layer 4 comprising a water resistant porous layer and a water absorptive resin, and a heat-sensitive adhesive resin layer 5 stacked in that order as viewd from the substrate sheet 1 side.

In the above embodiment of the protective layer transfer sheet 8 according to the present invention, the peel layer comprises at least a water soluble resin, fine particles, a curing agent, and a water dispersion-type polymer, and the coverage of the peel layer is not less than 0.1 $g/m^2$ and not more than 0.5 $g/m^2$. According to this construction, the thickness of the peel layer 3 can be reduced, and the thermally transferable protective layer 2 can be separated from the substrate sheet with good transferability.

The content of the water dispersion-type polymer in the peel layer may be in the range of 2 to 10% by weight. According to this construction, the strength of the peel layer can be improved, and the thermally transferable protective layer 2 can be separated from the substrate sheet with good transferability.

Further, the surface of a thermally transferred image comprising an image of a colorant can be covered with a protective layer to form a print which is stampable with an aqueous ink and, at the same time, has abrasion resistance, chemical resistance, and solvent resistance.

Figure 5:
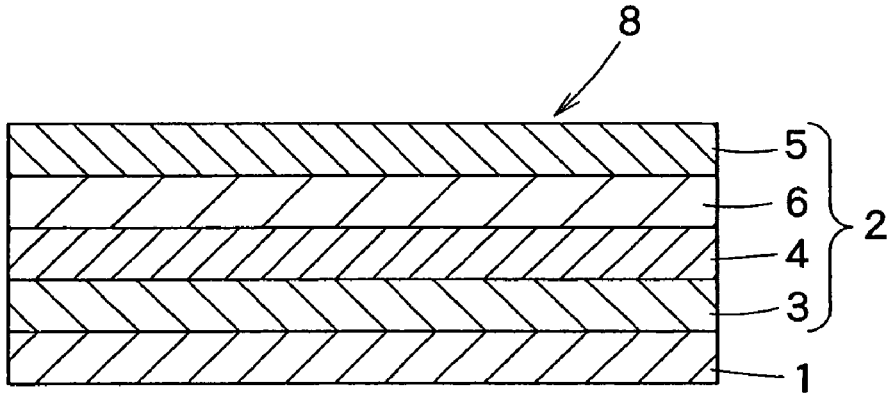
FIG. 5 is a cross-sectional view showing another embodiment of the protective layer transfer sheet according to the second aspect of the present invention.

FIG. 5 is a cross-sectional view illustrating another embodiment of the protective layer transfer sheet 8 according to the present invention. This protective layer transfer sheet 8 comprises a substrate sheet 1 and a thermally transferable protective layer 2 provided on one side of the substrate sheet 1. The thermally transferable protective layer 2 comprises a peel layer 3, a stampable and writable protective layer 4, an ultraviolet light shielding layer 6, and a heat-sensitive adhesive resin layer 5 stacked in that order as viewed from the substrate sheet 1 side. The protective layer transfer sheet 8 according to the present invention has, in addition to the above function, the function of preventing fading or discoloration attributable to ultraviolet light containing in the sunlight and the like.

Figure 6:
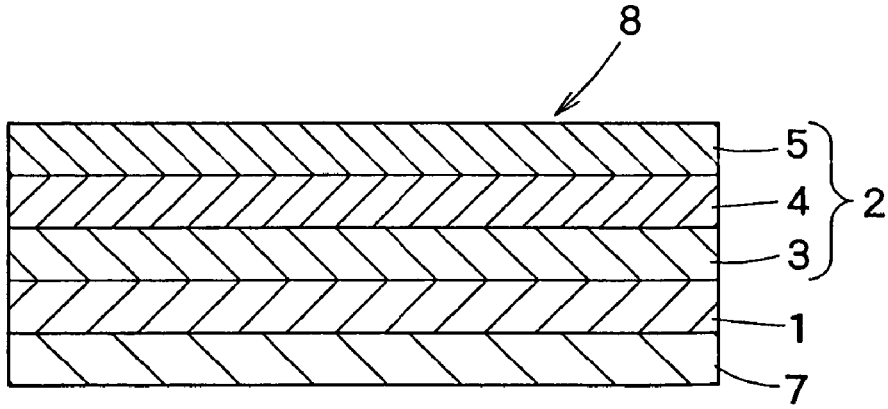
FIG. 6 is a cross-sectional view showing a further embodiment of the protective layer transfer sheet according to the second aspect of the present invention.

FIG. 6 is a cross-sectional view showing still another embodiment of the protective layer transfer sheet 8 according to the present invention. The protective layer transfer sheet 8 shown in FIG. 6 comprises a substrate sheet 1, a heat resistant slip layer 7 provided on one side of the substrate sheet 1, and a thermally transferable protective layer 2 provided on the other side of the substrate sheet 1. The thermally transferable protective layer 2 comprises a peel layer 3, a stampable and writable protective layer 4, and a heat-sensitive adhesive resin layer 5 provided in that order from the substrate sheet 1 side. The provision of the heat resistant slip layer 7 on the substrate sheet 1 in its side remote from the thermally transferable protective layer 2 can prevent the protective layer transfer sheet from sticking to a thermal head, a hot plate for transfer or the like of a printer and further can improve slipperiness.

Layer Construction

First Aspect

[Substrate Sheet]

In the protective layer transfer sheet of the present invention, any substrate sheet may be used as the substrate sheet 1 without particular limitation so far as the substrate sheet has film strength and heat resistance comparable to substrate sheets used in conventional thermal transfer sheets.

Specific examples of substrate sheets usable herein include films of plastics, for example, polyester resin films such as polyethylene terephthalate resin films, polycarbonate resin films, polyamide resin films, polyimide resin films, cellulose acetate resin films, polyvinylidene chloride resin films, polyvinyl chloride resin films, polystyrene resin films, fluororesin films, polypropylene resin films, polyethylene resin films, and ionomers. Further, for example, composite films or sheets formed by stacking two or more of the above films on top of each other or one another may also be used.

The thickness of the substrate sheet may be properly varied depending upon materials for the substrate sheet so that the substrate sheet has proper strength and heat resistance. In general, however, the thickness is preferably about 1 to 10 μm.

[Thermally Transferable Protective Layer]

The thermally transferable protective layer 2 according to the present invention is provided separably on at least a part of the substrate sheet, is stampable with an aqueous ink, is writable with a pen using an aqueous ink, and is further excellent in transferability, abrasion resistance, weathering resistance, chemical resistance, solvent resistance and the like.

The thermally transferable protective layer 2 comprises at least a peel layer 3, a stampable and writable protective layer 4, and a heat-sensitive adhesive resin layer 5 provided in that order.

The whole thickness of the thermally transferable protective layer 2 is preferably in the range of about 1.0 to 5.0 μm from the viewpoint of excellent layer transferability, water absorption, durability, and transparency.

When the whole thickness is less than 1.0 μm, durability such as abrasion resistance and water absorption are disadvantageously lowered, while, when the whole thickness is more than 5.0 μm, the transparency and the layer transferability are disadvantageously lowered.

[Peel Layer]

The peel layer 3 according to the present invention permits the thermally transferable protective layer 2 to be separated from the substrate sheet 1 and thermally transferred to an object. Upon the thermal transfer onto the object, the protective layer constitutes the uppermost surface. Therefore, the peel layer 3 should have durability such as abrasion resistance and a water absorptive property and, more preferably, has weathering resistance, chemical resistance, and solvent resistance.

Specifically, the peel layer 3 comprises a porous layer having transferability from the substrate sheet 1 and water absorption.

The adoption of a porous layer in the peel layer 3 is advantageous in that the amount of an aqueous ink or the like penetrated and absorbed into the stampable and writable protective layer can be regulated to some extent while retaining a water absorptive property in the surface of a thermally transferable protective layer.

The coverage of the porous layer on a dry basis as the peel layer 3 is preferably not less than 0.05 $g/m^2$ and not more than 1 $g/m^2$, more preferably not less than 0.1 $g/m^2$ and not more than 1 $g/m^2$, from the viewpoint of excellent layer transferability and water absorption.

When the coverage is less than 0.05 $g/m^2$, durability such as abrasion resistance is disadvantageously lowered, while, when the coverage is more than 1 $g/m^2$, the transferability is disadvantageously deteriorated.

The porous layer as the peel layer 3 comprises a binder of a water soluble resin, fine particles, and a curing agent as indispensable ingredients, and, if necessary, a water dispersible polymer, a dispersant, an antioxidant, an antistatic agent and the like may be added thereto.

The porous layer may be formed by dissolving or dispersing the ingredients such as the binder in a parent solvent such as water or an organic solvent to prepare a coating liquid, coating the coating liquid, and drying the coating.

The peel layer 3 may be formed using the above resin by gravure coating, gravure reverse coating, roll coating, and many other coating methods.

[Binder]

A water soluble resin should be used in the binder constituting the peel layer 3 according to the present invention. Specific examples thereof include polyvinyl alcohol (PVA) resins, water soluble polyester resins, alkyl vinyl ether resins, maleic acid copolymer resins, polyvinyl pyrrolidone resins, cellulose resins, water-soluble alkyd resins, and non-cellulosic water-soluble polysaccharides. Among them, polyvinyl alcohol resins are preferred because better stampability can be imparted to the thermally transferable protective layer.

Further, the use of the same resin as the binder is preferred, because the transferability of the thermally transferable protective layer from the substrate sheet, the adhesion between the peel layer and the water absorptive layer in the thermally transferable protective layer, and water absorption are excellent.

The number average molecular weight of the binder is preferably in the range of 10000 to 30000 from the viewpoint of excellent transferability of the thermally transferable protective layer 2 from the substrate sheet 1 at the time of thermal transfer.

When the number average molecular weight of the binder exceeds 30000, the layer transferability is unfavorably lowered.

[Curing Agent]

The curing agent reactive with an active functional group in the water soluble resin used as the binder according to the present invention is used for imparting water resistance and solvent resistance according to the form of curing by the reaction between the active functional group and the curing agent and, further, for regulating the molecular weight of the water-soluble resin to improve layer transferability.

Curing agents usable herein include, for example, Sumirez Resin series manufactured by Sumitomo Chemical Co., Ltd. typified by Sumirez Resin 5004 which is a polyamide resin-type curing agent.

The mixing ratio between the binder and the curing agent in the peel layer 3 according to the present invention is preferably not less than 0.05% and not more than 2% in terms of the ratio on a solid basis of the weight of curing agent added to the water soluble resin (curing agent/water soluble resin) from the viewpoint of excellent water resistance, solvent resistance, and layer transferability.

When the amount of the curing agent added exceeds the upper limit value of the above-defined amount range, layer transferability is disadvantageously deteriorated, while, when the amount of the curing agent added is below the lower limit value of the above-defined amount range, the water resistance and the solvent resistance are disadvantageously lowered.

[Fine Particles]

Fine particles constituting the peel layer 3 according to the present invention are used for forming a porous layer by dispersing the fine particles in water or an organic solvent, coating the dispersion, and drying the coating.

The fine particles may be in any form, for example, in a spherical, acicular, or amorphous form. In particular, the use of spherical particles is more preferred, because the uniformity of particle diameters can be maximized, the porosity can be increased, and the water absorption can be improved.

When the shape of the fine particles is nonuniform, the porosity is lowered, disadvantageously resulting in lowered water absorption.

The average particle diameter of the fine particles is preferably not more than 0.3 μm from the viewpoint of maintaining the transparent property, and more preferably not more than 0.1 μm.

When the average particle diameter of the fine particles is more than 0.3 μm, disadvantageously, it is difficult to maintain the transparency.

The material for constituting the fine particles may be any of organic and inorganic materials so far as the material is transparent. Organic fine particles include, for example, acrylic fine particles, cellulosic fine particles, and non-cellulosic polysaccharide fine particles. Inorganic fine particles include, for example, fine particles of silica or its modified product, alumina sols, and fine particles of other metals and metal oxides.

In particular, colloidal silica is preferred, because it is in the form of fine particles that as such have high solvent resistance and have a hydrophilic group on their surface.

For example, Snowtex series manufactured by Nissan Chemical Industry Ltd. and Cataloid series manufactured by Catalysts and. Chemicals Industries Co., Ltd. are preferred as the colloidal silica.

When the binder is a water soluble resin, the amount of the colloidal silica added preferably satisfies a mixing ratio requirement represented by formula 1/30≦water soluble resin/colloidal silica≦1/3 (mass ratio). When the mixing ratio is in the above-defined range, the amount of water absorption caused by the penetration of an aqueous ink or the like into the stampable and writable protective layer can be regulated to some extent and, at the same time, durability such as abrasion resistance can also be provided.

When the mixing ratio is less than 1/30, the effect as the binder is disadvantageously unsatisfactory. On the other hand, when the mixing ratio is more than 1/3, any porous structure cannot be formed and, consequently, the water absorption is disadvantageously lowered.

[Water Dispersible Polymer]

The water dispersible polymer is added to the peel layer 3 according to the present invention to improve the capability of holding the thermally transferable protective layer on the substrate sheet.

Specifically, for example, a polymeric material comprising at least one of polyester resins, polyurethane resins, polyacrylic resins, vinylidene chloride resins and the like may be used, and the selection of a resin having a good capability of holding the thermally transferable protective layer on the substrate sheet in corporation with the resin component in the substrate sheet is preferred.

The water dispersible polymer used in the present invention is a polymer which is soluble, emulsifiable or dispersible in water. A preferred water dispersible polyester resin is, for example, Vylonal manufactured by Toyobo Co., Ltd.

[Stampable and Writable Protective Layer]

The stamplable and writable protective layer 4 according to the present invention comprises a water resistant porous layer and a water absorptive resin.

[Water Absorptive Resin]

The material of the water absorptive resin constituting the stampable and writable protective layer 4 according to the present invention is not particularly limited so far as it has a water absorptive property. However, a water soluble material is preferred. Specific examples thereof include acrylic polyol resins, urethane polyol resins, cellulosic resins such as methylcellulose, carboxymethylcellulose, and hydroxyethylcellulose, synthetic polymers such as polyvinyl pyrrolidone resins, alkyl vinyl ethers, polymaleic acid copolymer resins, water-soluble polyester resins, and polyvinyl alcohol resins, inorganic polymers such as sodium polyphosphates, seaweed extracts such as agars and sodium alginate, plant viscous materials such as gum arabic and hibiscus, animal proteins such as caseins and gelatins, fermentation viscous materials such as pullulans and dextrans, starches, and starchy materials.

The weight average molecular weight of the water absorptive resin is preferably in the range of 6000 to 15000 from the viewpoint of excellent layer transferability.

When the weight average molecular weight of the water absorptive resin exceeds 15000, the layer transferability is disadvantageously deteriorated. On the other hand, when the weight average molecular weight of the water absorptive resin is less than 6000, the water resistance of the thermally transferable protective layer is disadvantageously deteriorated.

[Porous Layer]

The water resistant porous layer constituting the stampable and writable protective layer 4 according to the present invention, together with the water absorptive resin, retains an aqueous ink or the like being passed through the peel layer 3 and penetrated into the stampable and writable protective layer 4.

The porous layer is formed of a material which comprises a binder, fine particles, and a curing agent as indispensable ingredients and optionally dispersant.

The porous layer should have a water absorptive property and, more preferably, has weathering resistance, chemical resistance, water resistance, and solvent resistance.

The binder constituting the porous layer according to the present invention, and the curing agent and the dispersant may be the same as the materials used in the peel layer 3. For the fine particles as well, the shape, the average particle diameter, the constituent materials, and the addition amount may be the same as those in the fine particles used in the peel layer 3.

The porous layer may be formed by dissolving the binder and the curing agent in a parent solvent, for example, water or an organic solvent, mixing the resultant liquid, coating the liquid, and drying the coating.

The porous layer may be formed using the above resin by gravure coating, gravure reverse coating, roll coating, and many other coating methods.

[Binder]

A water soluble resin should be used in the binder constituting the porous layer according to the present invention. Further, a curing agent should be added to impart water resistance and solvent resistance.

Among others, the use of a polyvinyl alcohol resin as the binder and the use of, for example, a polyamide resin as the curing agent are preferred from the viewpoint of improved suitability for stamping.

The number average molecular weight of the binder is preferably in the range of 10000 to 80000 from the viewpoint of excellent layer transferability and water absorption.

When the number average molecular weight of the binder exceeds 80000, the layer transferability is unfavorably lowered.

[Curing Agent]

The curing agent reactive with the active functional group in the water soluble resin constituting the porous layer according to the present invention is used for bringing the water soluble resin to a cured form, through the reaction of the curing agent with the active functional group, which imparts water resistance and solvent resistance and, at the same time, regulate the molecular weight of the water soluble resin to improve layer transferability.

Curing agents usable herein include, for example, Sumirez Resin series manufactured by Sumitomo Chemical Co., Ltd. typified by Sumirez Resin 5004 which is a polyamide resin-type curing agent.

The mixing ratio between the binder and the curing agent in the peel layer 3 according to the present invention is preferably such that the ratio of the equivalent of the reactive group in the curing agent to the equivalent of the active group in the water soluble resin, the ratio on a solid basis of the weight of the curing agent added to the weight of the water soluble resin added, is not less than 0.05% and not more than 2% from the viewpoint of excellent water resistance, solvent resistance, and layer transferability.

When the mixing ratio is above the upper limit value of the above-defined range, the weight average molecular weight of the water soluble resin exceeds 30000, disadvantageously resulting in deteriorated layer transferability. On the other hand, the mixing ratio is below the lower limit value of the above-defined range, the water resistance and the solvent resistance are disadvantageously deteriorated.

[Ultraviolet Screening Layer]

In the present invention, in order to suppress fading or discoloration of an image, formed in a print on which a protective layer is to be transferred, caused by ultraviolet light contained in sunlight and the like, an ultraviolet screening layer is preferably provided on the thermally transferable protective layer.

The ultraviolet screening layer is formed by coating an ink comprising a resin with an ultraviolet absorber incorporated therein to form a film.

Ultraviolet absorbers usable herein include organic ultraviolet absorbers, such as benzophenone compounds, benzotriazole compounds, oxalic anilide compounds, cyanoacrylate compounds, and salicylate compounds. Inorganic fine particles having an ultraviolet absorbing capacity such as oxides of zinc, titanium, cerium, tin, iron and the like may also be added to the resin.

The resin used is not particularly limited, and any resin may be used. Examples of resins usable herein include acrylic resins, polyester resins, urethane resins, styrene resins, halogenated vinyl resins, vinyl acetate resins, polycarbonate resins, phenolic resins, melamine resins, epoxy resins, cellulose resins, hydrocarbon resins such as polyethylene, vinyl resins such as polyvinyl alcohol and polyvinyl pyrrolidone, and copolymers thereof. Alternatively, a method may also be adopted in which the ultraviolet screening layer is not additionally provided and the ultraviolet absorber is added to the water absorptive surface layer or the heat-sensitive adhesive resin layer.

Further, a method may also be adopted in which a reactive ultraviolet absorber is reacted with and bonded to the resin and this treated resin is added solely or as a mixture to the peel layer 3, the stampable and writable protective layer 4 and/or the heat-sensitive adhesive resin layer 5 or is provided as an ultraviolet screening layer.

The reactive ultraviolet absorber may be reacted with and fixed to the resin by various methods. For example, a copolymer may be prepared by radically polymerizing a conventional monomer, oligomer, or a reactive polymer as a resin component with the above-described reactive ultraviolet absorber having an addition-polymerizable double bond.

When the reactive ultraviolet absorber contains, for example, a hydroxyl, amino, carboxyl, epoxy, or isocyanate group, a method may be used in which a thermoplastic resin having a group reactive with the above functional group is used and the reactive ultraviolet absorber is reacted with and fixed to the thermoplastic resin by heat or the like optionally in the presence of a catalyst. Monomer components copolymerizable with the reactive ultraviolet absorber include, for example, methyl (meth)acrylate, ethyl (meth)acrylate, propyl (meth)acrylate, butyl (meth)acrylate, isobutyl (meth) acrylate, tert-butyl (meth)acrylate, isodecyl (meth)acrylate, lauryl (meth)acrylate, lauryltridecyl (meth)acrylate, tridecyl (meth)acrylate, cerylstearyl (meth)acrylate, stearyl (meth) acrylate, ethylhexyl (meth)acrylate, octyl (meth)acrylate, cyclohexyl (meth)acrylate, benzyl (meth)acrylate, methacrylic acid, hydroxyethyl (meth)acrylate, hydroxypropyl (meth)acrylate, dimethylaminoethyl (meth)acrylate, diethylaminoethyl (meth)acrylate, tert-butylaminoethyl (meth) acrylate, glycidyl (meth)acrylate, tetrahydrofurfuryl (meth) acrylate, ethylene di(meth)acrylate, diethylene glycol (meth) acrylate, triethylene glycol di(meth)acrylate, tetraethylene glycol di(meth)acrylate, decaethylene glycol (meth)acrylate, pentadecaethylene (meth)acrylate, pentacontahectaethylene glycol (meth)acrylate, butylene di(meth)acrylate, aryl (meth)acrylate, trimethylolpropane (meth)acrylate, hexanediol di(meth)acrylate, tripropylene glycol dimethacrylate, pentaerythritol tetra(meth)acrylate, pentaerythritonyl hexa(meth)acrylate, 1,6-hexanediol di(meth)acrylate, neopentylglycol penta(meth)acrylate, and phosphazene hexa (meth)acrylate.

The above materials may be used not only as monomers but also as oligomers. Further, polyester acrylate, epoxyacrylate or other acrylic reactive polymers comprising polymers of the above materials or derivatives thereof may also be used. These monomers, oligomers, and acrylic reactive polymers may be used either solely or as a mixture of two or more.

A thermoplastic copolymer resin with a reactive ultraviolet absorber reacted and fixed thereto is produced by copolymerizing the monomer, oligomer or acrylic reactive polymer of the thermoplastic resin with the reactive ultraviolet absorber. The copolymer resin preferably contains 10 to 90% by weight, preferably 30 to 70% by weight, of the reactive ultraviolet absorber. When the reactive ultraviolet absorber content is below the lower limit of the above defined content range, satisfactory lightfastness cannot be provided without difficulties. On the other hand, when the reactive ultraviolet absorber content is above the upper limit of the above defined content range, problems disadvantageously occur such as tackiness at the time of coating and bleeding of a dye image upon the adhesion of the ultraviolet screening layer to the image.

The molecular weight of the copolymer resin is preferably about 5,000 to 50,000, more preferably about 9,000 to 40,000. When the molecular weight is less than 5000, the film strength is so low that the roughness is unsatisfactory for the protective layer.

On the other hand, when the molecular weight of the copolymer resin exceeds 50000, the viscosity is increased, disadvantageously rendering handling troublesome. Further, in this case, disadvantageously, layer transferability is adversely affected.

The ultraviolet screening layer according to the present invention may be formed of a resin with the reactive ultraviolet absorber being reacted therewith and bonded thereto. This layer may consist of this resin alone or, if necessary, may be formed of a mixture of this resin with other resin.

In the formation of the ultraviolet screening layer on the water absorptive layer, when the adhesion between the ultraviolet screening layer and the water absorptive layer is poor, a primer layer may be formed.

Resins usable for the formation of the primer layer include urethane resins, polyester resins, polypropylene resins, polyol resins, and products of reactions between these resins and isocyanates.

Isocyanates usable herein include diisocyanate compounds and triisocyanate compounds.

The thickness of the primer layer is preferably in the range of 0.1 to 10 μm.

As shown in FIG. 2, the ultraviolet screening layer 6 is preferably provided between the stampable and writable protective layer 4 and the heat-sensitive adhesive resin layer 5. The ultraviolet screening layer 6 may be formed by the same method as used in the formation of the water absorptive layer, and the thickness thereof is preferably about 0.1 to 5 μm.

[Heat-Sensitive Adhesive Resin Layer]

In the present invention, the heat-sensitive adhesive resin layer 5 constituting the thermally transferable protective layer 2 is formed to realize good adhesion between the protective layer formed by the transfer of the thermally transferable protective layer 2 and the printed face upon the transfer of the thermally transferable protective layer 2 onto the printed face.

Resins usable for the heat-sensitive adhesive resin layer 5 include, for example, acrylic resins, vinyl chloride resins, vinyl acetate resins, vinyl chloride-vinyl acetate copolymer resins, styrene-acryl copolymer resins, polyester resins, and polyamide resins.

The heat-sensitive adhesive resin layer may be formed by brining one or at least two of these resins to a coatable form such as a solution or emulsion, coating the coating liquid by any suitable coating method described above in connection with the transparent resin layer, and drying the coating.

The thickness of the heat-sensitive adhesive resin layer 5 is preferably about 0.1 to 5 μm.

The heat-sensitive adhesive resin layer 5 may comprise the above resin and additives, for example, organic ultraviolet absorbers such as benzophenone compounds, benzotriazole compounds, oxalic anilide compounds, cyanoacrylate compounds, and salicylate compounds, or inorganic fine particles having ultraviolet absorption capacity, such as oxides of zinc, titanium, cerium, tin, iron or the like. Further, if necessary, color pigments, white pigments, extender pigments, fillers, antistatic agents, antioxidants, fluorescent brighteners and the like may also be properly used as additives.

An adhesive layer preferably having a thickness of about 0.5 to 10 μm on a dry basis is formed by coating a coating liquid containing the above resin for constituting the adhesive layer and optionally the above additives and then drying the coating.

[Heat Resistant Slip Layer]

Further, in the protective layer transfer sheet according to the present invention, as shown in FIG. 3, if necessary, a heat resistant slip layer 7 may be provided on the heat resistant substrate sheet 1 in its side remote from the thermally transferable protective layer 2 from the viewpoints of preventing sticking to a thermal head of a printer, a hot plate for transfer or the like and improving the slip properties.

A conventional resin, such as a resin prepared by curing a butyral resin or the like with an isocyanate compound or a silicone resin, as such may be used for constituting the heat resistant slip layer 7. The thickness of the heat resistant slip layer may be about 0.1 to 5 μm.

The heat resistant slip layer 7 may if necessary be provided through a primer layer.

Next, in the present invention, the thermally transferable protective layer 2 may be provided solely on the substrate sheet 1 to form a transfer film for a thermally transferable protective layer 2 only. Alternatively, for example, thermal transfer ink layers, such as thermally sublimable dye ink layers of yellow, magenta, and cyan or a heat-fusion type transfer ink layer of black (containing carbon black), may be arranged in a face serial manner on an identical substrate to form an integral thermal transfer sheet comprising thermal transfer ink layers and a thermally transferable protective layer 2 arranged in a face serial manner on an identical substrate.

In the case of the integral transfer film, the plate pattern is not particularly limited. For example, a transfer film with the following layer patterns being repeatedly provided in a face serial manner may be mentioned (In the following description, for colors, yellow is referred to as "Ye", magenta as "Mg", cyan as "Cy", and black as "Bk"): (1) Ye dye layer, Mg dye layer, Cy dye layer, and thermally transferable protective layer, (2) Ye dye layer, Mg dye layer, Cy dye layer, Bk dye layer, and thermally transferable protective layer, (3) Ye dye layer, Mg dye layer, Cy dye layer, Bk heat-fusion ink layer, and thermally transferable protective layer, (4) Bk dye layer and thermally transferable protective layer, and (5) Bk heat-fusion ink layer and thermally transferable protective layer. In these plate patterns, the size of the Bk dye layer, the Bk heat-fusion ink layer, and the thermally transferable protective layer may be larger than the other layers.

A detection mark for detecting each layer may be provided anywhere in each layer. For example, it may be provided at the head of each layer area or at the head in the color in the front position.

In the integral transfer sheet comprising ink layers and a thermally transferable protective layer arranged in a face serial manner on an identical substrate, registration in these predetermined patterns followed by overprinting is necessary. In this case, an additive, such as a fluorescent brightener, may be incorporated into each layer to permit the registration to be easily performed visually or in a mechanical detection manner upon ultraviolet irradiation or the like.

Regarding the thermal transfer ink layers, inks and methods for the conventional thermal transfer sheet as such may be used for the material of the ink used, the method for providing the ink on the surface of the substrate sheet and the like.

Images to be protected by using the thermal transfer film for a protective layer are usually those formed by the thermal dye transfer method and/or the heat-fusion ink transfer method. In particular, when the thermal transfer film for a protective layer is applied to an image formed by the thermal dye transfer, a protective layer is formed on the image and, at the same time, the dye constituting the image is again subjected to color development by heat applied at the time of transfer, offering the effect of rendering the image clearer.

The thermal dye transferred image and/or the heat-fusion thermal transferred image is formed by using a thermal transfer sheet having a thermally sublimable ink layer, a thermal transfer sheet having a heat-fusion ink layer, or the protective layer transfer sheet according to the present invention onto an image-receiving sheet or a card substrate comprising a plastic sheet substrate of a polyester resin, a vinyl chloride resin, a vinyl chloride/vinyl acetate copolymer resin, a polycarbonate or the like, a thermal transfer image-receiving sheet comprising a dye-receptive resin layer (a receptive layer) on a substrate sheet described below, or a film, a sheet, or a molded product of the above resin to form a thermally transferred image recorded object of the present invention.

Dye-receptive resins usable herein include polyolefin resins, such as polypropylene; halogenated resins, such as polyvinyl chloride and polyvinylidene chloride; vinyl resins, such as polyvinyl acetate and various polyacrylates; polyester resins, such as polyethylene terephthalate and polybutylene terephthalate; polystyrene resins, such as polystyrene or copolymers thereof; polyamide resins; resins of copolymers of olefins, such as ethylene or propylene with other vinyl monomers; ionomers; cellulosic resins, such as cellulose diacetate, and cellulose triacetate; and polycarbonates. A release agent, such as a silicone oil, may be incorporated into the resin layer in order to prevent the resin layer from fusing to the thermal transfer sheet for a protective layer.

The receptive layer may be formed by a coating method or by thermal transfer using a thermal head, a hot roll or the like.

When the sheet substrate per se is receptive to a dye, there is no need to provide the receptive layer.

Sheet substrates usable in the thermal transfer image-receiving sheet include synthetic papers (polyolefin, polystyrene or other types of synthetic papers), wood free paper, art paper, coat paper, cast coated paper, wall paper, backing paper, paper impregnated with a synthetic resin solution or an emulsion, paper impregnated with a synthetic rubber latex, paper with a synthetic resin being internally added thereto, paperboard, and natural fiber papers such as cellulose fiber papers, and films of polyolefin, polyvinyl chloride, polyethylene terephthalate, polystyrene, polymethyl methacrylate, and polycarbonate. They may be used in a single-layer or multilayer structure.

[Card Substrate]

Next, materials for cards as an object, on which an image is to be formed, will be described.

The card substrate used in the present invention comprises a resin dyeable with a thermally sublimable dye.

For example, polyolefine, polyvinyl chloride, polyethylene terephthalate, polystyrene, polymethacrylate, and polycarbonate films may be used.

Further, for example, white opaque films or sheets formed from a synthetic resin with a white pigment or a filler added thereto, or a foamed sheet; and synthetic papers (polyolefin, polystyrene or other types of synthetic papers) as such may be used. If necessary, a dye-receptive layer may be formed thereon.

Further, for example, wood free paper, art paper, coat paper, cast coated paper, wall paper, backing paper, paper impregnated with a synthetic resin solution or emulsion, paper impregnated with a synthetic rubber latex, paper with a synthetic resin being internally added thereto, paperboard, and cellulose fiber paper, each having a dye-receptive layer, may also be used. Laminates of any combination of the above plastic films and the like may also be used.

One example of preferred card substrates according to the present invention has such a construction that a transparent polyvinyl chloride layer is laminated on both sides of a center layer of a polyvinyl chloride sheet containing a white pigment with a suitable amount of a plasticizer incorporated into at least the transparent vinyl chloride layer as an image forming face to improve the dyeability of the layer with the dye.

Further, coloring pigments, white pigments, extender pigments, fillers, ultraviolet absorbers, antistatic agents, thermal stabilizers, antioxidants, fluorescent brighteners and the like may be optionally used on the dye receiving face of the thermally transferred image recorded object (print).

Further, a desired magnetic recording layer, emboss pattern or other print pattern, an optical memory, an IC memory, a bar code and the like may be previously formed on the card substrate for a thermally transferred image recorded object. Further, the magnetic recording layer or the like may be provided before or after the formation of information on a photograph of a face or the like by the thermal dye transfer system or the like.

Furthermore, an emboss pattern, a signature, an IC memory, a magnetic layer, a hologram, or other print may also be provided on the card. The emboss pattern, signature, magnetic layer or the like may be provided after the transfer of the thermally transferable protective layer. The photograph-like image of a face may be provided on the card substrate by using the thermal dye transfer sheet according to the present invention.

At the same time, information on letters, bar codes and the like may be formed by using the thermal dye transfer sheet. Preferably, the above information is formed using a heat-fusion ink type thermal transfer sheet which enables high-density black printing.

A color image and/or a letter image are formed on an image-receiving sheet, a card or the like by using a thermal transfer sheet by means of a thermal printer, and a thermally transferable protective layer is transferred thereon using the protective layer transfer sheet according to the present invention to form a protective layer. Alternatively, the protective layer transfer sheet according to the present invention, having a thermal transfer ink layer may be used.

In the transfer, separate thermal printers may be used under separate conditions for the thermal dye transfer, the heat-fusion transfer, and the transfer of the protective layer. Alternatively, a single printer may be used while properly regulating printing energy for each of transfer operation.

In the thermal transfer film for a protective layer according to the present invention, heating means is not limited to the thermal printer, and other heating means, such as a hot plate, a hot stamper, a hot roll, a line heater, and an iron may also be used.

The thermally transferable protective layer may be transferred on the whole surface of the formed image or on a desired area of the image.

The protective layer transfer sheet according to the present invention can be used for thermal transfer to prepare cards such as identification (ID) cards, various certificates, and license, can realize stamping with an aqueous ink or writing with a pen using an aqueous ink on a thermally transferred image recorded object originally having no aqueous ink fixation, is excellent in transferability of the thermally transferable protective layer from the substrate sheet and in transfer stability, and can yield a protective layer which is excellent in durability such as abrasion resistance and scratch resistance, weathering resistance, chemical resistance, solvent resistance and the like.

Second Aspect

Details of the layer construction except for layers which will be described later, that is, details of the substrate sheet, the thermally transferable protective layer, the curing agent, the fine particles, the water dispersible polymer, the stampable and writable protective layer, the porous layer, the binder, the curing agent, the ultraviolet screening layer, the heat-sensitive adhesive resin layer, the heat resistant slip layer, and the card substrate, may be the same as those described above in connection with the first aspect of the present invention.

[Peel Layer]

The peel layer 3 according to the present invention permits the thermally transferable protective layer 2 to be separated from the substrate sheet 1 and thermally transferred to an object. Upon the thermal transfer onto the object to form a protective layer, the protective layer constitutes the uppermost surface. Therefore, the peel layer 3 should have durability such as abrasion resistance and a water absorptive property and, more preferably, has weathering resistance, chemical resistance, and solvent resistance. Specifically, the peel layer 3 comprises a porous layer having transferability from the substrate sheet 1 and water absorption. The adoption of a porous layer in the peel layer 3 is advantageous in that the amount of an aqueous ink or the like penetrated and absorbed into the stampable and writable protective layer can be regulated to some extent while retaining a water absorptive property in the surface of a thermally transferable protective layer.

The porous layer as the peel layer 3 comprises a binder of a water soluble resin, fine particles, a curing agent, and a water dispersible polymer, as indispensable ingredients, and, if necessary, a dispersant, an antioxidant, an antistatic agent and the like may be added thereto. In particular, the addition of a water dispersible polymer can improve the adhesion between the peel layer and the heat resistant substrate sheet. The content of the water dispersible polymer in the peel layer 3 is preferably in the range of 2 to 10% by weight. When the coverage of the peel layer on a dry basis is not less than 0.1 $g/m^2$ and not more than 0.5 $g/m^2$, the layer transferability can be advantageously improved. When the coverage of the peel layer is less than 0.1 $g/m^2$, durability such as abrasion resistance is disadvantageously lowered, while, when the coverage of the peel layer is more than 0.5 $g/m^2$, the layer transferability is disadvantageously lowered.

The water dispersible polymer according to the present invention may be, for example, a polymeric material containing at least one of polyester resins, polyurethane resins, polyacrylic resins, vinylidene chloride resins and the like. In particular, in the present invention, the resin constituting the water dispersible polymer in the peel layer is more preferably the same as the resin constituting the heat resistant substrate sheet, because the adhesion between the peel layer and the heat resistant substrate sheet can be improved. Further, the content of the water dispersible polymer in the peel layer is preferably in the range of 2 to 10% by weight. In this case, the strength of the peel layer is improved, and, hence, a layer having a thickness of about 0.1 μm can be formed, whereby excellent layer transferability can be realized.

When the content of the water dispersible polymer is less than 2% by weight, the formation of a layer having a thickness of about 0.1 μm is disadvantageously difficult. On the other hand, when the content of the water dispersible polymer exceeds 10% by weight, properties such as sticking after storage are disadvantageously lowered.

The polyester resin according to the present invention is a polyester resin, which comprises a dibasic acid and glycol and is soluble, emulsifiable or dispersible in water and is a polyester copolymer of the acid component with the glycol component.

Dibasic acids as the acid component include sulfonic acid group-containing dicarboxylic acids and other dicarboxylic acids. Sulfonic acid group-containing dicarboxylic acids include metal sulfonate-containing dicarboxylic acids. Metal sulfonate-containing dicarboxylic acids include, for example, metal salts (for example, alkali metal salts and alkaline earth metal salts) of sulfoterephthalic acid, 5-sulfoisophthalic acid, 4-sulfophthalic acid, 4-sulfonaphthalene-2,7-dicarboxylic acid, and 5-[4-sulfophenoxy]isophthalic acid. Preferred are sodium sulfoterephthalic acid and 5-sodium sulfoisophthalate.

Other dicarboxylic acids are conventional dicarboxylic acids not containing a metal sulfonate, and examples thereof include aromatic, aliphatic, and alicyclic dicarboxylic acids. Aromatic dicarboxylic acids include, for example, terephthalic acid, isophthalic acid, orthophthalic acid, and 2,6-naphthalene dicarboxylic acid. Aliphatic dicarboxylic acids include succinic acid, adipic acid, and sebacic acid. Alicyclic dicarboxylic acids include 1,3-cyclopentane dicarboxylic acid, 1,2-cyclohexane dicarboxylic acid, 1,3-cyclohexane dicarboxylic acid, and 1,4-cyclohexane dicarboxylic acid.

Glycol components include aliphatic glycols having 2 to 8 carbon atoms (for example, ethylene glycol, 1,2-propylene glycol, 1,3-propanediol, 1,4-butanediol, neopentyl glycol, 1,6-hexanediol, diethylene glycol, and triethylene glycol), alicyclic glycols having 6 to 12 carbon atoms (for example, 1,2-cyclohexane dimethanol and 1,4-cyclohexane dimethanol), and mixtures of these two kinds of glycols. Additional examples of glycol components include aromatic glycols (for example, p-xylene glycol), polyalkylene ether glycols (for example, polyethylene glycol, polypropylene glycol, and polytetramethylene glycol).

The polyester copolymer may be prepared by conventional melt polycondensation. Examples of such methods include, but are not particularly limited to, a direct esterification method which comprises directly reacting the dicarboxylic acid component with the glycol component, removing water by evaporation to conduct esterification, and then conducting polycondensation, and a transesterification method which comprises reacting a dimethyl ester of the dicarboxylic acid component with the glycol component, removing methyl alcohol by evaporation to conduct transesterification, and then conducting polycondensation. In addition, copolymers can also be prepared, for example, by solution polycondensation and interfacial polycondensation.

The porous layer may be formed by dissolving or dispersing the ingredients such as the binder in a parent solvent such as water or an organic solvent to prepare a coating liquid, coating the coating liquid, and drying the coating.

The peel layer 3 may be formed using the above resin by gravure coating, gravure reverse coating, roll coating, and many other coating methods.

[Binder]

A water soluble resin should be used in the binder constituting the peel layer 3 according to the present invention from the viewpoints of imparting a water absorptive property to the protective layer after thermal transfer. Specific examples thereof include polyvinyl alcohol (PVA) resins, water soluble polyester resins, alkyl vinyl ether resins, maleic acid copolymer resins, polyvinyl pyrrolidone resins, cellulose resins, water-soluble alkyd resins, and non-cellulosic water-soluble polysaccharides. Among them, polyvinyl alcohol resins are preferred because better stampability can be imparted to the thermally transferable protective layer. Further, the use of the same resin as the binder is preferred, because the transferability of the thermally transferable protective layer from the substrate sheet, the adhesion between the peel layer and the water absorptive layer in the thermally transferable protective layer, and water absorption are excellent. The number average molecular weight of the binder is preferably in the range of 10000 to 90000 from the viewpoint of excellent transferability of the thermally transferable protective layer 2 from the substrate sheet 1 at the time of thermal transfer. When the number average molecular weight of the binder exceeds 90000, the layer transferability is unfavorably lowered.

[Water Absorptive Resin]

The water absorptive resin may be basically the same as that described above in connection with the first aspect of the present invention. In the second aspect of the present invention, however, the weight average molecular weight of the water absorptive resin is preferably in the range of 6000 to 1500000 from the viewpoint of excellent layer transferability. When the weight average molecular weight of the water absorptive resin exceeds 1500000, the layer transferability is disadvantageously lowered. On the other hand, when the weight average molecular weight of the water absorptive resin is less than 6000, the water resistance of the thermally transferable protective layer is disadvantageously lowered.

[Ultraviolet Screening Layer]

The ultraviolet screening layer may be basically the same as that described above in connection with the first aspect of the present invention. In the second aspect of the present invention, however, in the formation of the ultraviolet screening layer 6 on the stampable and writable protective layer 4, when the adhesion between the ultraviolet screening layer 6 and the stampable and writable protective layer 4 is poor, a primer layer may be formed.

EXAMPLES

First Aspect

The following Examples and Comparative Examples further illustrate the first aspect of the present invention.

Example A1

A 5.2 μm-thick polyethylene terephthalate (PET) film was provided as a substrate sheet. A coating liquid for a heat resistant slip layer comprising a silicone resin was gravure coated on one side of the substrate sheet at a coverage of 0.7 $g/m^2$ on a dry basis to form a heat resistant slip layer. A coating liquid for a peel layer having the following composition was coated on the other side of the substrate sheet at a coverage of 1.0 $g/m^2$ on a dry basis, and the coating was dried to form a peel layer. Further, a coating liquid for a porous layer having the following composition was gravure coated onto the peel layer at a coverage of 2.0 $g/m^2$ on a dry basis, and the coating was dried to form a porous layer. A coating liquid for a water absorptive resin having the following composition was then gravure coated onto the porous layer at a coverage of 0.5 $g/m^2$ on a dry basis so as to infiltrate into the porous layer, thereby allowing the liquid to penetrate into voids. As a result, a stampable and writable protective layer was formed. A coating liquid for a heat-sensitive adhesive resin layer having the following composition was then gravure coated on the stampable and writable protective layer at a coverage of 1.2 $g/m^2$ on a dry basis, and the coating was dried to form a heat-sensitive adhesive resin layer. Thus, a protective layer transfer sheet of Example A1 according to the present invention having a layer construction of heat-sensitive adhesive resin layer/stampable and writable protective layer (water absorptive resin-porous layer)/peel layer/substrate sheet/heat resistant slip layer was prepared.

| | |
|---|---|
| [Composition of coating liquid for peel layer] | |
| Polyvinyl alcohol resin (Poval C506, manufactured by Kuraray Co., Ltd.; number average molecular weight: about 30,000) | 1.08 pts. wt. |
| Colloidal silica dispersion (Snowtex OL-40, manufactured by Nissan Chemical Industry Ltd.; average particle diameter: about 20 nm) | 7.5 pts. wt. |
| Water dispersion-type polyester resin (Vylonal MD-1500, manufactured by Toyobo Co., Ltd.) | 0.2 pt. wt. |
| Curing agent (Sumirez Resin 5004, manufactured by Sumitomo Chemical Co., Ltd.) | 0.045 pt. wt. |
| Isopropyl alcohol | 18 pts. wt. |
| Water | 5 pts. wt. |
| [Composition of coating liquid for porous layer] | |
| Polyvinyl alcohol resin (Poval C318, manufactured by Kuraray Co., Ltd.; number average molecular weight: about 80,000) | 0.24 pt. wt. |
| Colloidal silica dispersion (Snowtex OL-40, manufactured by Nissan Chemical Industry Ltd.; average particle diameter: about 20 nm) | 8 pts. wt. |
| Curing agent (Sumirez Resin 5004, manufactured by Sumitomo Chemical Co., Ltd.) | 0.1 pt. wt. |
| Isopropyl alcohol | 3 pts. wt. |
| Water | 1 pt. wt. |
| [Composition of water absorptive resin coating liquid] | |
| Polyvinyl pyrrolidone resin (PVP K-90, manufactured by ISP Japan Ltd.; weight average molecular weight: about 900,000 to 1,500,000) | 4 pts. wt. |
| Acrylic polyol (Dianal LR 209, manufactured by Mitsubishi Rayon Co., Ltd.) | 10 pts. wt. |
| Urethane polyol (SANPRENE IB114, manufactured by Sanyo Chemical Industries, Ltd.) | 3 pts. wt. |
| Methyl ethyl ketone | 40 pts. wt. |
| Isopropyl alcohol | 25 pts. wt. |
| [Composition of coating liquid for heat-sensitive adhesive resin layer] | |
| Polyester resin (Vylon 700, manufactured by Toyobo Co., Ltd.) | 8 pts. wt. |
| Acrylic resin (PUVA 50M, manufactured by Otsuka Chemical Co., Ltd.) | 2 pts. wt. |
| Ultraviolet absorber (Tinuvin 900, manufactured by Ciba Specialty Chemicals, K.K.) | 1 pt. wt. |
| Methyl ethyl ketone | 40 pts. wt. |
| Toluene | 40 pts. wt. |

Next, a thermal dye transfer-type thermal transfer sheet for a thermal dye transfer printer manufactured by Mitsubishi Electric Corporation (MITUBISHI CP710) and an overcoat-type thermal transfer image-receiving sheet for the same printer were provided. The thermal transfer image-receiving sheet and the thermal dye transfer-type thermal transfer sheet were put on top of each other so that the receptive layer in the thermal transfer image-receiving sheet came into contact with the dye layer face of the thermal dye transfer-type thermal transfer sheet. 10 sheets of a thermally transferred image recorded object of a black solid image were continuously formed with a thermal dye transfer printer manufactured by Mitsubishi Electric Corporation (MITUBISHI CP710) under an environment temperature of 45° C.

The thermal transfer image-receiving sheet used was prepared by providing a synthetic paper (Yupo FRG-150, thickness 150 microns; manufactured by Oji-Yuka Synthetic Paper Co., Ltd.) as a substrate sheet for the image-receiving sheet, bar-coating a coating liquid for a dye-receptive layer having the following composition onto one side of the substrate sheet at a coverage of 4 g/m$^2$ on a dry basis, and then drying the coating to form a dye-receptive layer.

| [Coating liquid for dye-receptive layer formation] | |
|---|---|
| Vinyl chloride-vinyl acetate copolymer (Denka Vinyl 1000A, manufactured by Denki Kagaku Kogyo K.K.) | 20 pts. wt. |
| Epoxy-modified silicone oil (X-22-2900T, manufactured by The Shin-Etsu Chemical Co., Ltd.) | 1 pt. wt. |
| Methyl ethyl ketone | 40 pts. wt. |
| Toluene | 40 pts. wt. |

A protective layer transfer sheet of Example A1 prepared above was put on top of the black solid image formed by the above method, and the thermally transferable protective layer was transferred from the protective layer transfer sheet by the same printer as used in the formation of the black solid image to form a black solid image with a protective layer.

As a result, the protective layer transfer sheet of Example A1 was excellent in transferability of the thermally transferable protective layer from the substrate sheet at the time of transfer onto the above image, and could yield a thermally transferred image recorded object with a protective layer that was excellent in stampability with an aqueous ink, writability with a pen using an aqueous ink, durability such as abrasion resistance and scratch resistance, weathering resistance, chemical resistance, solvent resistance and the like.

Example A2

A protective layer transfer sheet of Example A2 was formed in the same manner as in Example A1, except that the composition of the coating liquid for a peel layer and the composition of the coating liquid for a stampable and writable protective layer were changed to the following respective compositions.

| [Composition of coating liquid for peel layer] | |
|---|---|
| Polyvinyl alcohol resin (Poval C318, manufactured by Kuraray Co., Ltd.; number average molecular weight: about 90,000) | 1.08 pts. wt. |
| Colloidal silica dispersion (Snowtex OL-40, manufactured by Nissan Chemical Industry Ltd.; average particle diameter: about 20 nm) | 7.5 pts. wt. |
| Water dispersion-type polyester resin (Vylonal MD-1500, manufactured by Toyobo Co., Ltd.) | 0.2 pt. wt. |
| Curing agent (Sumirez Resin 5004, manufactured by Sumitomo Chemical Co., Ltd.) | 0.045 pt. wt. |
| Isopropyl alcohol | 18 pts. wt. |
| Water | 5 pts. wt. |

| [Composition of coating liquid for stampable and writable protective layer] | |
|---|---|
| Polyvinyl pyrrolidone resin (PVP K-15, manufactured by ISP Japan Ltd.; weight average molecular weight: about 6000 to 15000) | 4 pts. wt. |
| Acrylic polyol (Dianal LR 209, manufactured by Mitsubishi Rayon Co., Ltd.) | 10 pts. wt. |
| Urethane polyol (SANPRENE IB114, manufactured by Sanyo Chemical Industries, Ltd.) | 3 pts. wt. |
| Methyl ethyl ketone | 40 pts. wt. |
| Isopropyl alcohol | 25 pts. wt. |

The protective layer transfer sheet of Example A2 prepared above was put on top of a black solid image formed in the same manner as in Example A1, and the thermally transferable protective layer was transferred by the same printer as used in the formation of the black solid image to form a black solid image with a protective layer.

As a result, the protective layer transfer sheet of Example A2 was excellent in transferability of the thermally transferable protective layer from the substrate sheet at the time of transfer onto the above image, and could yield a thermally transferred image recorded object with a protective layer that was excellent in stampability with an aqueous ink, writability with a pen using an aqueous ink, durability such as abrasion resistance and scratch resistance, weathering resistance, chemical resistance, solvent resistance and the like.

Example A3

A protective layer transfer sheet of Example A3 was formed in the same manner as in Example A1, except that the composition of the coating liquid for a peel layer was changed to the following composition.

| [Composition of coating liquid for peel layer] | |
|---|---|
| Polyvinyl alcohol resin (Poval C506, manufactured by Kuraray Co., Ltd.; number average molecular weight: about 30,000) | 1.08 pts. wt. |
| Colloidal silica dispersion (Snowtex OL-40, manufactured by Nissan Chemical Industry Ltd.; average particle diameter: about 20 nm) | 7.5 pts. wt. |
| Water dispersion-type polyester resin (Vylonal MD-1500, manufactured by Toyobo Co., Ltd.) | 0.2 pt. wt. |
| Curing agent (Sumirez Resin 5004, manufactured by Sumitomo Chemical Co., Ltd.) | 0.015 pt. wt. |
| Isopropyl alcohol | 18 pts. wt. |
| Water | 5 pts. wt. |

The protective layer transfer sheet of Example A3 prepared above was put on top of a black solid image formed in the same manner as in Example A1, and the thermally transferable protective layer was transferred by the same printer as used in the formation of the black solid image to form a black solid image with a protective layer.

As a result, the protective layer transfer sheet of Example A3 was excellent in transferability of the thermally transferable protective layer from the substrate sheet at the time of transfer onto the above image, and could yield a thermally transferred image recorded object with a protective layer that was excellent in stampability with an aqueous ink, writability with a pen using an aqueous ink, durability such as abrasion resistance and scratch resistance, weathering resistance, chemical resistance, solvent resistance and the like.

Comparative Example A1

A protective layer transfer sheet of Comparative Example A1 was formed in the same manner as in Example A1, except that the composition of the coating liquid for a peel layer was changed to the following composition.

| [Composition of coating liquid for peel layer] | |
|---|---|
| Polyvinyl alcohol resin (Poval C318, manufactured by Kuraray Co., Ltd.; number average molecular weight: about 90,000) | 1.08 pts. wt. |
| Colloidal silica dispersion (Snowtex OL-40, manufactured by Nissan Chemical Industry Ltd.; average particle diameter: about 20 nm) | 7.5 pts. wt. |
| Water dispersion-type polyester resin (Vylonal MD-1500, manufactured by Toyobo Co., Ltd.) | 0.2 pt. wt. |
| Curing agent (Sumirez Resin 5004, manufactured by Sumitomo Chemical Co., Ltd.) | 0.045 pt. wt. |
| Isopropyl alcohol | 18 pts. wt. |
| Water | 5 pts. wt. |

The protective layer transfer sheet of Comparative Example A1 prepared above was put on top of a black solid image formed in the same manner as in Example A1, and the thermally transferable protective layer was transferred by the same printer as used in the formation of the black solid image to form a black solid image with a protective layer.

As a result, the protective layer transfer sheet of Comparative Example A1 was poor in transferability of the thermally transferable protective layer from the substrate sheet at the time of transfer onto the above image.

Comparative Example A2

A protective layer transfer sheet of Comparative Example A2 was formed in the same manner as in Example A1, except that the composition of the coating liquid for a peel layer was changed to the following composition.

| [Composition of coating liquid for peel layer] | |
|---|---|
| Polyvinyl alcohol resin (Poval C506, manufactured by Kuraray Co., Ltd.; number average molecular weight: about 30,000) | 1.08 pts. wt. |
| Colloidal silica dispersion (Snowtex OL-40, manufactured by Nissan Chemical Industry Ltd.; average particle diameter: about 20 nm) | 7.5 pts. wt. |
| Water dispersion-type polyester resin (Vylonal MD-1500, manufactured by Toyobo Co., Ltd.) | 0.2 pt. wt. |
| Isopropyl alcohol | 18 pts. wt. |
| Water | 5 pts. wt. |

The protective layer transfer sheet of Comparative Example A2 prepared above was put on top of a black solid image formed in the same manner as in Example A1, and the thermally transferable protective layer was transferred by the same printer as used in the formation of the black solid image to form a black solid image with a protective layer.

As a result, the protective layer transfer sheet of Comparative Example A2 was poor in transferability of the thermally transferable protective layer from the substrate sheet at the time of transfer onto the above image.

Evaluation Test A

The thermally transferred image recorded objects of Examples A1 to A3 and Comparative Examples A1 and A2 having a thermally transferred protective layer on the surface of a black solid image were evaluated for layer transferability and water resistance by the following evaluation method and according to the following evaluation criteria.

[Layer Transferability]

The surface of the black solid image part with the protective layer formed by the transfer of a thermally transferable protective layer using the protective layer transfer sheets of Examples A1 to A3 and Comparative Examples A1 and A2 was visually inspected for evaluation for uniform layer transferability and tailing according to the following criteria. The results are shown in Table A1.

(Evaluation Criteria)

◎: No tailing, and no transferability problem

○: No tailing with lifting, and no transferability problem

Δ: 1 to 5 sheets suffering from tailing with lifting

X: 6 to 10 sheets suffering from tailing with lifting

[Water Resistance]

The upper part of the protective layer in each of the thermally transferred image recorded objects prepared using the protective layer transfer sheets of Examples A1 to A3 and Comparative Examples A1 and A2 was rubbed with a tap water-impregnated swab (antimicrobial swab H101, manufactured by PIP-TOKYO Co., Ltd.) by reciprocating the swab under a load of 10 g ten times. Thereafter, the degree of staining of the black solid image part with the protective layer was visually inspected and was evaluated according to the following criteria. The results are shown in Table A1.

(Evaluation Criteria)

○: No damage to black solid image part, and no problem

X: Thermally transferred protective layer rubbed away, posing a problem

TABLE A1

| | Layer transferability | Water resistance |
|---|---|---|
| Ex. A1 | ◎ | ○ |
| Ex. A2 | ○ | ○ |
| Ex. A3 | ○ | ○ |
| Comp. Ex. A1 | X | ○ |
| Comp. Ex. A2 | X | X |

As is apparent from the results shown in Table A1, as compared with Comparative Example A1 (conventional product), in the thermally transferred image recorded object formed using the protective layer transfer sheet of Example A1, the layer transferability could be improved by reducing the molecular weight of the polyvinyl alcohol resin (binder) constituting the peel layer, and the water resistance was comparable to that of the conventional product.

In Example A2, as compared with Comparative Example A1 (conventional product), the layer transferability could also be improved by reducing the molecular weight of the polyvinyl pyrrolidone resin constituting the water absorptive resin, and the water resistance was comparable to that of the conventional product.

In Example A3, as compared with Comparative Example A1 (conventional product), the layer transferability could also be improved by reducing the amount of the curing agent added to the peel layer, and the water resistance was comparable to that of the conventional product.

In Comparative Example A2, as compared with Comparative Example A1 (conventional product), since any curing agent was not added to the peel layer, the layer transferability and the water resistance were poor.

Second Aspect

The following Examples and Comparative Examples further illustrate the second aspect of the present invention.

Example B1

A 5.2 μm-thick polyethylene terephthalate (PET) film was provided as a substrate sheet. A coating liquid for a heat resistant slip layer comprising a silicone resin was gravure coated on one side of the substrate sheet at a coverage of 0.7 g/m$^2$ on a dry basis to form a heat resistant slip layer. A coating liquid for a peel layer having the following composition was coated on the other side of the substrate sheet at a coverage of 0.5 g/m$^2$ on a dry basis, and the coating was dried to form a peel layer. Further, a coating liquid for a porous layer having the following composition was gravure coated onto the peel layer at a coverage of 2.0 g/m$^2$ on a dry basis, and the coating was dried to form a porous layer. A coating liquid for a water absorptive resin having the following composition was then gravure coated onto the porous layer at a coverage of 0.5 g/m$^2$ on a dry basis so as to infiltrate into the porous layer, thereby allowing the liquid to penetrate into voids. As a result, a stampable and writable protective layer was formed. A coating liquid for a heat-sensitive adhesive resin layer having the following composition was then gravure coated on the stampable and writable protective layer at a coverage of 1.2 g/m$^2$ on a dry basis, and the coating was dried to form a heat-sensitive adhesive resin layer. Thus, a protective layer transfer sheet of Example B1 according to the present invention having a layer construction of heat-sensitive adhesive resin layer 5/stampable and writable protective layer 4/peel layer 3/substrate sheet 1/heat resistant slip layer 7 was prepared.

[Composition of coating liquid for peel layer]

| | |
|---|---|
| Polyvinyl alcohol resin (C318, manufactured by Kuraray Co., Ltd.; number average molecular weight: about 80,000) | 1.08 pts. wt. |
| Colloidal silica dispersion (Snowtex OL-40, manufactured by Nissan Chemical Industry Ltd.; average particle diameter: about 20 nm) | 7.5 pts. wt. |
| Water dispersion-type polyester resin (Vylonal MD-1500, manufactured by Toyobo Co., Ltd.) | 0.2 pt. wt. |
| Curing agent (Sumirez Resin 5004, manufactured by Sumitomo Chemical Co., Ltd.) | 0.045 pt. wt. |
| Isopropyl alcohol | 18 pts. wt. |
| Water | 5 pts. wt. |

[Composition of coating liquid for porous layer]

| | |
|---|---|
| Polyvinyl alcohol resin (12% solution) (C318, manufactured by Kuraray Co., Ltd.; number average molecular weight: about 80,000) | 0.24 pt. wt. |
| Colloidal silica dispersion (Snowtex OL-40, manufactured by Nissan Chemical Industry Ltd.; average particle diameter: about 20 nm) | 8 pts. wt. |
| Curing agent (Sumirez Resin 5004, manufactured by Sumitomo Chemical Co., Ltd.) | 0.1 pt. wt. |
| Isopropyl alcohol | 3 pts. wt. |
| Water | 1 pt. wt. |

-continued

[Composition of water absorptive resin coating liquid]

| | |
|---|---|
| Polyvinyl pyrrolidone resin (PVP K-90, manufactured by ISP Japan Ltd.; weight average molecular weight: about 900,000 to 1,500,000) | 4 pts. wt. |
| Acrylic polyol (Dianal LR 209, manufactured by Mitsubishi Rayon Co., Ltd.) | 10 pts. wt. |
| Urethane polyol (SANPRENE IB114, manufactured by Sanyo Chemical Industries, Ltd.) | 3 pts. wt. |
| Methyl ethyl ketone | 40 pts. wt. |
| Isopropyl alcohol | 25 pts. wt. |

[Composition of coating liquid for heat-sensitive adhesive resin layer]

| | |
|---|---|
| Polyester resin (Vylon 700, manufactured by Toyobo Co., Ltd.) | 8 pts. wt. |
| Acrylic resin (PUVA 50 M, manufactured by Otsuka Chemical Co., Ltd.) | 2 pts. wt. |
| Ultraviolet absorber (Tinuvin 900, manufactured by Ciba Specialty Chemicals, K.K.) | 1 pt. wt. |
| Methyl ethyl ketone | 40 pts. wt. |
| Toluene | 40 pts. wt. |

Next, a thermal dye transfer-type thermal transfer sheet for a thermal dye transfer printer manufactured by Mitsubishi Electric Corporation (MITUBISHI CP710) and an overcoat-type thermal transfer image-receiving sheet for the same printer were provided. The thermal transfer image-receiving sheet and the thermal dye transfer-type thermal transfer sheet were put on top of each other so that the receptive layer in the thermal transfer image-receiving sheet came into contact with the dye layer face of the thermal dye transfer-type thermal transfer sheet. 10 sheets of a print of a black solid image were continuously formed with a thermal dye transfer printer manufactured by Mitsubishi Electric Corporation (MITUBISHI CP710) under an environment temperature of 45° C. The thermal transfer image-receiving sheet used was prepared by providing a synthetic paper (Yupo FRG-150, thickness 150 microns; manufactured by Oji-Yuka Synthetic Paper Co., Ltd.) as a substrate sheet for the image-receiving sheet, bar-coating a coating liquid for a dye-receptive layer having the following composition onto one side of the substrate sheet at a coverage of 4 g/m$^2$ on a dry basis, and then drying the coating to form a dye-receptive layer.

[Coating liquid for dye-receptive layer formation]

| | |
|---|---|
| Vinyl chloride-vinyl acetate copolymer (Denka Vinyl 1000 A, manufactured by Denki Kagaku Kogyo K.K.) | 20 pts. wt. |
| Epoxy-modified silicone oil (X-22-2900T, manufactured by The Shin-Etsu Chemical Co., Ltd.) | 1 pt. wt. |
| Methyl ethyl ketone | 40 pts. wt. |
| Toluene | 40 pts. wt. |

A protective layer transfer sheet of Example B1 prepared above was put on top of the black solid image formed by the above method, and the thermally transferable protective layer was transferred from the protective layer transfer sheet by the same printer as used in the formation of the black solid image to form a black solid image with a protective layer. As a result, the protective layer transfer sheet of Example B1 was excellent in transferability of the thermally transferable protective layer from the substrate sheet at the time of transfer onto the above image, and could yield a print with a protective layer that did not cause a deterioration in quality after storage and was excellent in stampability with an aqueous ink, writability with a pen using an aqueous ink, durability such as abrasion resistance and scratch resistance, weathering resistance, chemical resistance, solvent resistance and the like.

Example B2

A protective layer transfer sheet of Example B2 was formed in the same manner as in Example B1, except that the coating liquid for the peel layer was coated at a coverage of 0.25 g/m$^2$.

The protective layer transfer sheet of Example B2 prepared above was put on top of a black solid image formed in the same manner as in Example B1, and the thermally transferable protective layer was transferred by the same printer as used in the formation of the black solid image to form a black solid image with a protective layer. As a result, the protective layer transfer sheet of Example B2 was excellent in transferability of the thermally transferable protective layer from the substrate sheet at the time of transfer onto the above image, and could yield a print with a protective layer that did not cause a deterioration in quality after storage and was excellent in stampability with an aqueous ink, writability with a pen using an aqueous ink, durability such as abrasion resistance and scratch resistance, weathering resistance, chemical resistance, water resistance, solvent resistance and the like.

Example B3

A protective layer transfer sheet of Example B3 was formed in the same manner as in Example B1, except that the composition of the coating liquid for a peel layer was changed as follows.

| [Composition of coating liquid for peel layer] | |
|---|---|
| Polyvinyl alcohol resin (C318, manufactured by Kuraray Co., Ltd.; number average molecular weight: about 80,000) | 0.84 pt. wt. |
| Colloidal silica dispersion (Snowtex OL-40, manufactured by Nissan Chemical Industry Ltd.; average particle diameter: about 20 nm) | 7 pts. wt. |
| Water dispersion-type polyester resin (Vylonal MD-1500, manufactured by Toyobo Co., Ltd.) | 0.6 pt. wt. |
| Curing agent (Sumirez Resin 5004, manufactured by Sumitomo Chemical Co., Ltd.) | 0.015 pt. wt. |
| Isopropyl alcohol | 18 pts. wt. |
| Water | 5 pts. wt. |

The protective layer transfer sheet of Example B3 prepared above was put on top of a black solid image formed in the same manner as in Example B1, and the thermally transferable protective layer was transferred by the same printer as used in the formation of the black solid image to form a black solid image with a protective layer. As a result, the protective layer transfer sheet of Example B3 was excellent in transferability of the thermally transferable protective layer from the substrate sheet at the time of transfer onto the above image, and could yield a print with a protective layer that did not cause a deterioration in quality after storage and was excellent in stampability with an aqueous ink, writability with a pen using an aqueous ink, durability such as abrasion resistance and scratch resistance, water resistance, weathering resistance, chemical resistance, solvent resistance and the like.

Example B4

A protective layer transfer sheet of Example B4 was formed in the same manner as in Example B1, except that the composition of the coating liquid for a peel layer was changed to the following composition.

| [Composition of coating liquid for peel layer] | |
|---|---|
| Polyvinyl alcohol resin (C318, manufactured by Kuraray Co., Ltd.; number average molecular weight: about 80,000) | 0.84 pt. wt. |
| Colloidal silica dispersion (Snowtex OL-40, manufactured by Nissan Chemical Industry Ltd.; average particle diameter: about 20 nm) | 7 pts. wt. |
| Water dispersion-type polyester resin (Vylonal MD-1500, manufactured by Toyobo Co., Ltd.) | 1.6 pts. wt. |
| Curing agent (Sumirez Resin 5004, manufactured by Sumitomo Chemical Co., Ltd.) | 0.015 pt. wt. |
| Isopropyl alcohol | 18 pts. wt. |
| Water | 5 pts. wt. |

The protective layer transfer sheet of Example B4 prepared above was put on top of a black solid image formed in the same manner as in Example B1, and the thermally transferable protective layer was transferred by the same printer as used in the formation of the black solid image to form a black solid image with a protective layer. As a result, the protective layer transfer sheet of Example B4 was excellent in transferability of the thermally transferable protective layer from the substrate sheet at the time of transfer onto the above image, and could yield a print with a protective layer that did not cause a deterioration in quality after storage and was excellent in stampability with an aqueous ink, writability with a pen using an aqueous ink, durability such as abrasion resistance and scratch resistance, water resistance, weathering resistance, chemical resistance, solvent resistance and the like.

Comparative Example B1

A protective layer transfer sheet of Comparative Example B1 was formed in the same manner as in Example B1, except that the coating liquid for a peel layer was coated at a coverage of 1.0 g/m$^2$.

The protective layer transfer sheet of Comparative Example B1 prepared above was put on top of a black solid image formed in the same manner as in Example B1, and the thermally transferable protective layer was transferred by the same printer as used in the formation of the black solid image to form a black solid image with a protective layer. As a result, the protective layer transfer sheet of Comparative Example B1 was poor in transferability of the thermally transferable protective layer from the substrate sheet at the time of transfer onto the above image.

Comparative Example B2

A protective layer transfer sheet of Comparative Example B2 was formed in the same manner as in Example B1, except that the composition of the coating liquid for a peel layer was changed to the following composition.

| [Composition of coating liquid for peel layer] | |
|---|---|
| Polyvinyl alcohol resin (C318, manufactured by Kuraray Co., Ltd.; number average molecular weight: about 80,000) | 0.84 pt. wt. |
| Colloidal silica dispersion (Snowtex OL-40, manufactured by Nissan Chemical Industry Ltd.; average particle diameter: about 20 nm) | 7 pts. wt. |
| Water dispersion-type polyester resin (Vylonal MD-1500, manufactured by Toyobo Co., Ltd.) | 2 pts. wt. |
| Isopropyl alcohol | 18 pts. wt. |
| Water | 5 pts. wt. |

The protective layer transfer sheet of Comparative Example B2 prepared above was put on top of a black solid image formed in the same manner as in Example B1, and the thermally transferable protective layer was transferred by the same printer as used in the formation of the black solid image to form a black solid image with a protective layer. As a result, the protective layer transfer sheet of Comparative Example B2 was poor in properties of after storage. That is, at the time of transfer of the protective layer from the protective layer transfer sheet onto the above image, for example, sticking occurred between the substrate sheet and the thermally transferable protective layer.

Evaluation Test B

The prints of Examples B1 to B4 and Comparative Examples B1 and B2 having a thermally transferred protective layer on the surface of a black solid image were evaluated for layer transferability, water resistance, and properties after storage by the following evaluation method and according to the following evaluation criteria.

[Layer Transferability]

The surface of the black solid image part with the protective layer formed by the transfer of a thermally transferable protective layer using the protective layer transfer sheets of Examples B1 to B4 and Comparative Examples B1 and B2 under an environmental temperature of 40° C. was visually inspected for evaluation for uniform layer transferability and tailing according to the following criteria. The results are shown in Table B1.

(Evaluation Criteria)

◎: No tailing, and no transferability problem

○: No tailing with lifting, and no transferability problem

Δ: 1 to 5 sheets suffering from tailing with lifting

X: 6 to 10 sheets suffering from tailing with lifting

[Water Resistance]

The upper part of the protective layer in each of the prints prepared using the protective layer transfer sheets of Examples B1 to B4 and Comparative Examples B1 and B2 was rubbed with a tap water-impregnated swab (antimicrobial swab H101, manufactured by PIP-TOKYO Co., Ltd.) by reciprocating the swab under a load of 10 g ten times. Thereafter, the degree of staining of the black solid image part with the protective layer was visually inspected and was evaluated according to the following criteria. The results are shown in Table B1.

(Evaluation Criteria)

○: No damage to black solid image part, and no problem

X: Thermally transferred protective layer rubbed away, posing a problem

[Storage Stability]

Each of the protective layer transfer sheets of Examples B1 to B4 and Comparative Examples B1 and B2 was stored in a small roll state under 40° C. and an environment humidity 90% for 24 hr. Thereafter, 10 sheets of prints were continuously formed with MITUBISHI CP710(a thermal dye transfer printer manufactured by Mitsubishi Electric Corporation) under an environmental temperature (40° C.) and an environmental humidity (90%) to conduct inspection for heat fusing, that is, sticking, between the backside of the protective layer transfer sheet and the thermal head, and the prints were visually inspected for harshness of the thermally transferred protective layer formed on the black solid image by the transfer of the thermally transferred protective layer. The results are shown in Table B1.

(Evaluation Criteria)

○: Occurrence of no sticking and no harshness of the surface, posing no storage stability problem X: Occurrence of sticking on the printed face and harshness of the surface, posing a storage stability problem

TABLE B1

| | Layer transferability | Water resistance | storage stability |
|---|---|---|---|
| Ex. B1 | ○ | ○ | ◎ |
| Ex. B2 | ◎ | ○ | ◎ |
| Ex. B3 | ◎ | ○ | ◎ |
| Ex. B4 | ◎ | ○ | ○ |
| Comp. Ex. B1 | X | ○ | ◎ |
| Comp. Ex. B2 | ◎ | ○ | X |

As is apparent from the results shown in Table B1, for prints in which a thermally transferred image was covered with a protective layer thermally transferred from the protective layer transfer sheet prepared in Examples B1 and B2, by virtue of a reduction in coverage of the peel layer, the layer transferability could be improved over that for Comparative B1 (conventional product), and the storage stability and the water resistance were comparable to those for the conventional product. For Examples B3 and B4 in which the coverage of the peel layer was smaller than that in the case of Comparative Example B1 (conventional product) and the content of the water dispersible polymer in the peel layer was in the range of 2 to 10% by weight, the layer transferability could be improved, and the storage stability and the water resistance were comparable to those of the conventional product. For Comparative Example B2 in which the content of the water dispersible polymer in the peel layer exceeded 10% by weight, as compared with Comparative Example B1 (conventional product), the storage stability was inferior, and, when the protective layer transfer sheet was in a small roll state, the adhesive strength at the interface of the heat resistant slip layer (on reverse side of the protective layer transfer sheet) and the thermally transferable protective layer (on obverse side of the protective layer transfer sheet) was disadvantageously high. Further, in this case, abnormal transfer phenomena such as occurrence of sticking and surface harshness disadvantageously occurred.

The invention claimed is:

1. A protective layer transfer sheet comprising: a substrate sheet; and a thermally transferable protective layer provided on at least a part of one side of the substrate sheet, wherein said thermally transferable protective layer forms a protective layer having a water absorptive property upon thermal transfer, said thermally transferable protective layer comprises at least a peel layer, a stampable and writable protective layer formed of a water resistant porous layer and a water absorptive resin, and a heat-sensitive adhesive resin layer provided in that order as viewed from the substrate sheet side, and said peel layer comprises at least a water soluble resin, fine particles having an average particle diameter of not more than 0.3 μm, and a curing agent, said water soluble resin having a number average molecular weight in the range of 10000 to 30000.

2. A protective layer transfer sheet comprising: a substrate sheet; and a thermally transferable protective layer provided on at least a part of one side of the substrate sheet, wherein said thermally transferable protective layer forms a protective layer having a water absorptive property upon thermal transfer, said thermally transferable protective layer comprises at least a peel layer, a stampable and writable protective layer formed of a water resistant porous layer and a water absorptive resin, and a heat-sensitive adhesive resin layer provided in that order as viewed from the substrate sheet side, and said peel layer comprises at least a water soluble resin, fine particles having an average particle diameter of not more than 0.3 μm, and a curing agent, said water absorptive resin having a weight average molecular weight in the range of 6000 to 15000.

3. The protective layer transfer sheet according to claim 1, wherein said peel layer is in a cured form formed from a water soluble resin having an active functional group and a curing agent reactive with the active functional group, and the ratio on a solid basis between said water soluble resin and the weight of said curing agent added is in the range of $0.05 \leqq$ curing agent/water soluble resin $\leqq 2$.

4. The protective layer transfer sheet according to claim 1, wherein the coverage of the peel layer is not less than 0.05 $g/m^2$ and not more than 200 $g/m^2$.

5. The protective layer transfer sheet according to claim 1, wherein said thermally transferable protective layer contains an ultraviolet absorbing material.

6. The protective layer transfer sheet according to claim 1, wherein said sheet further comprises at least one of a thermally sublimable colorant layer and a heat-fusion colorant layer.

7. A thermally transferred image recorded object comprising a thermally transferred image covered with a protective layer which has been thermally transferred from the protective layer transfer sheet according to claim 1.

8. The thermally transferred image recorded object according to claim 7, wherein a stamp of an aqueous ink has been affixed onto the thermally transferred protective layer in the thermally transferred image recorded object.

9. A protective layer transfer sheet comprising: a substrate sheet; and a thermally transferable protective layer provided on at least a part of one side of the substrate sheet, wherein said thermally transferable protective layer forms a protective layer having a water absorptive property upon thermal transfer, said thermally transferable protective layer comprises at least a peel layer, a stampable and writable protective layer formed of a water resistant porous layer and a water absorptive resin, and a heat-sensitive adhesive resin layer provided in that order as viewed from the substrate sheet side, and said peel layer comprises at least a water soluble resin, fine particles having an average particle diameter of not more than 0.3 μm, a curing agent, and a water dispersible polymer, the coverage of said peel layer being not less than 0.1 $g/m^2$ and not more than 0.5 $g/m^2$.

10. The protective layer transfer sheet according to claim 9, wherein the content of the water dispersible polymer in the peel layer is in the range of 2 to 10% by weight.

11. The protective layer transfer sheet according to claim 9, wherein said thermally transferable protective layer contains an ultraviolet absorbing material.

12. The protective layer transfer sheet according to claim 9, wherein said sheet further comprises at least one of a thermally sublimable colorant layer and a heat-fusion colorant layer.

13. A print comprising a thermally transferred image covered with a protective layer which has been thermally transferred from the protective layer transfer sheet according to claim 9.

14. The print according to claim 13, wherein a stamp can be affixed using an aqueous ink onto the thermally transferred protective layer in the print.

15. The protective layer transfer sheet according to claim 2, wherein said sheet further comprises at least one of a thermally sublimable colorant layer and a heat-fusion colorant layer.

16. The protective layer transfer sheet according to claim 10, wherein said sheet further comprises at least one of a thermally sublimable colorant layer and a heat-fusion colorant layer.

* * * * *